US006640070B2

(12) United States Patent
Sanmonji

(10) Patent No.: US 6,640,070 B2
(45) Date of Patent: Oct. 28, 2003

(54) IMAGE FORMING APPARATUS INCLUDING A CONDUCTIVE FILM ATTACHED TO A CLEANING BLADE

(75) Inventor: Yoshinori Sanmonji, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/022,802

(22) Filed: Dec. 20, 2001

(65) Prior Publication Data

US 2003/0118371 A1 Jun. 26, 2003

(51) Int. Cl.[7] ..... G03G 21/00
(52) U.S. Cl. ..... 399/129; 399/343; 399/350
(58) Field of Search ..... 399/123, 127, 399/129, 343, 350, 354

(56) References Cited

U.S. PATENT DOCUMENTS 4,479,709 A * 10/1984 Syukuri et al. ..... 399/129
4,956,677 A * 9/1990 Akiyama ..... 399/129
5,862,432 A * 1/1999 Nakayama et al. ..... 399/129 X
6,208,819 B1 * 3/2001 Pai et al. ..... 399/129 X
6,442,362 B2 * 8/2002 Hirabayashi et al. ... 399/129 X
6,466,758 B2 * 10/2002 Chigono et al. ..... 399/253

FOREIGN PATENT DOCUMENTS

JP 3-127086 5/1991

* cited by examiner

*Primary Examiner*—Hoan Tran
(74) *Attorney, Agent, or Firm*—Foley & Lardner

(57) ABSTRACT

A method and apparatus for forming an image is provided by visualizing a latent image on a photosensitive member with a toner having an electrical resistance, transferring the visualized image to an image recording medium, cleaning with a cleaning blade a residual toner adhering to a surface of the photosensitive member after the transfer of the latent image to the image recording medium, and charge injecting a biasing voltage of a predetermined magnitude to the residual toner with a conductive polyester film, whereby at least part of a surface potential of the photosensitive member is removed. The conductive polyester film is fixedly attached to a tip end of the cleaning blade.

20 Claims, 3 Drawing Sheets

| | NON-CONDUCTIVE CLEANING BLADE | NON-CONDUCTIVE CLEANING BLADE + CONDUCTIVE MYLAR |
|---|---|---|
| APPLIED VOLTAGE (V) | N/A | AC: 1.2kV DC: -0.4kV FR: 300Hz |
| TIME *T* (s) | 1.6 | 0.4 |

IMAGE FORMING APPARATUS INCLUDING A CONDUCTIVE FILM ATTACHED TO A CLEANING BLADE

BACKGROUND OF THE INVENTION

1. Field of the Invention

The present invention relates to improvements on a discharging or diselectrifying mechanism provided in an image forming apparatus and, more specifically, to an image forming apparatus, which is equipped with a mechanism for effectively erasing positive charge remaining on a photosensitive drum of the image forming apparatus and also for making possible smooth build-up of charging.

2. Description of the Related Art

An image forming apparatus as represented by a copying machine is generally constructed including a photosensitive drum (i.e. a latent image carrier), an electrostatic charging device or charger for imparting a surface electrical charge to the photosensitive drum to form a desired latent image thereon, exposure means for altering the surface potential on the photosensitive drum by exposure with a laser beam thereby to form the desired latent image, a developing apparatus equipped with a developing roller for holding and feeding a toner onto the photosensitive drum to visualize the latent image carried on the drum, a transfer device for transferring the visualized image onto a sheet of image recording paper, a cleaning device for cleaning the photosensitive drum surface by removing and collecting the residual toner remaining on the drum after the image has been transferred to the image recording paper sheet, and a diselectrifying or erase lamp for erasing the residual charge for the latent image remaining on the photosensitive drum surface after the image has been transferred to the image recording paper sheet.

In the image forming apparatus with such an arrangement, although the toner stuck on the photosensitive drum surface is transferred onto the image recording paper sheet via the transfer device, the toner is not necessarily transferred entirely, but part of the toner is attached as the residual toner on the drum surface in an image-shaped distribution. Such residual toner is removed by the cleaning device and recovered in a waste toner recovery receiver. In this manner, the photosensitive drum surface is cleaned and, thereafter, the entire photosensitive drum surface is subjected to light exposure by the discharging lap, thus erasing the charge existing on the drum surface for the next operation including the steps of charging and exposure.

For the discharging or diselectrifying step to erase the electrical charge on the photosensitive drum surface, various method are known, including discharging by radiating light from any light source against the photosensitive drum surface, AC discharging by corona charging the photosensitive drum surface, and discharging by application of AC voltage with a cleaning blade coated with a conductive material such as carbon black or aluminum powder.

Such conventional discharging methods have had various problems as follows. In the method using light radiation, during the step of printing image on a recording paper sheet, the portion on the photosensitive drum surface which is reverse-charged by direct transfer charging, without via an image recording paper sheet in contact with the photosensitive drum, may fail to be discharged by light radiation, thus fogging appearing on such portion on the photosensitive drum surface. In a high-speed or small-size printer in which the period of time until the photosensitive drum is charged subsequent to its discharging is very short, a charge potential may be varied with variation in the discharging light amount unless the carrier movement speed of the photosensitive drum is fast enough.

In the AC discharging method using corona charging, it is necessary to provide an additional space for installation of a corona charger. This makes it difficult to construct a photosensitive drum having a smaller diameter and hence infeasible to apply to a small-size printer. Furthermore, the method of using the conductive cleaning blade is disadvantageous in that the blade surface may be partially peeled off or dropped out by friction of the blade edge coated with conductive material with the photosensitive drum. Especially, in a developing system using toner of small-diameter particles, poor cleaning may occur disadvantageously.

In view of a limited installation space for a positive charge erasing mechanism, it is difficult to install it in a small-size printer having a photosensitive drum with a diameter of about 30 mm, and a conductive blade is used to aid in diselectrifying the positive charge. Since such a blade is coated on it's surface with conductive material, however, repeated passage of image recording paper sheets will peel off or nick at the edge surface of the blade, thereby inviting a decrease in discharging capability and/or poor cleaning, which in turn causes deteriorated image formation.

A discharging mechanism is disclosed in Japanese Patent Application KOKAI Publication No. 3-127086. This mechanism makes it possible to form quality images merely by using a conductive brush which performs the function of cleaning and discharging, dispensing with a cleaning device. Since the conductive blade does cleaning, however, the cleaning effect becomes inevitably poor with an increase in the number of prints. Thus, the diselectrification efficiency is affected by an increasing number of prints and the image quality is decreased, accordingly. Thus, the problem remains unsolved.

SUMMARY OF THE INVENTION

The present invention has been made in view of the above-described problems and, therefore, it is an object of the present invention to provide an image forming apparatus which is capable of producing high-quality images by diselectrifying positive charge with high efficiency, in particular, on a small-diameter photosensitive drum and hence permitting rapid build-up of charging.

For achieving this object, the invention provides an image forming apparatus comprising: a photosensitive member for forming thereon a latent image; a developing apparatus for visualizing said latent image on said photosensitive member with a toner having an electrical resistance; a transfer device for transferring said visualized image to an image recording medium; and bias means for applying a bias voltage of a predetermined magnitude to residual toner remaining on the surface of said photosensitive member after the transfer to said image recording medium by said transfer device, whereby at least part of surface potential of said photosensitive member is removed.

With such an arrangement, since the surface potential of the photosensitive drum is diselectrified by application of a bias voltage to the residual toner remaining on the surface of the photosensitive drum, the surface of the photosensitive drum, which is in contact with the residual toner, can be discharged efficiently. Additionally, the discharging mechanism can not only be simplified, but also the period of time until the photosensitive drum is charged after its discharging can be shortened, with the result that the image forming apparatus can be made compact suitable for a small-size image forming unit.

The image forming apparatus of the present invention is characterized in that it further comprises a non-conductive cleaning blade for removing the residual toner adhering on the surface of the photosensitive member after the transfer of the image onto the image-transferred material, and a conductive polyethylene terephalate (i.e., Mylar®) fixedly attached to the tip end of the cleaning blade, the conductive polyethylene terephalate being arranged so as to be applied with a voltage and operable to charge the residual toner remaining on the surface of the photosensitive member by charge injection from the voltage applied to the conductive polyethylene terephalate itself. Discharging can be accomplished more effectively by providing means such as transport paddle for making part of the residual toner to be accumulated uniformly over the surface of the photosensitive member.

With such a structure, the waste toner (residual toner) removed by cleaning with the cleaning blade is accumulated uniformly on the photosensitive member surface and a voltage is applied by charge injection from the conductive polyethylene terephalate which is then charged by a bias voltage. By so doing, the residual charge existing on the photosensitive member can be diselectrified by the electrically charged residual toner and the charge build-up performance in the next charging step can be accelerated. Moreover, the use of the conductive polyethylene terephalate permits utilization of a conventional non-conductive cleaning blade which is made of an elastic material such as rubber, thereby making it possible to maintain satisfactory cleaning capability.

The image forming apparatus according to the invention is further characterized in that the conductive polyethylene terephalate is applied with a bias voltage which is formed by imposing DC voltage of −0.7 kV or more on AC voltage of 1.2 kV or more with a frequency of 300 Hz or greater.

In an image forming unit constructed according to the present invention and using a low-resistant toner such as magnetic toner, a non-conductive cleaning blade equipped with the conductive polyethylene terephalate is located above the photosensitive member. With such an arrangement, applying to the conductive polyethylene terephalate a bias voltage which is formed by imposing DC voltage of −0.7 kV or greater on AC voltage of 1.2 kV or more with a frequency of 300 Hz or more thereby to electrically charge the residual toner by charge injection makes it possible to diselectrify with maximum efficiency the residual charge present on the surface of the photosensitive drum which is then in contact with the residual toner.

The image forming apparatus according to the invention is further characterized in that the cleaning blade is made of an elastic material.

By providing a cleaning blade which is made of a non-conductive elastic material such as rubber and hence flexible, the blade can be used in various shapes or forms suitable for maintenance of good cleaning performance. Thus, cleaning of the surface of a cylindrical shaped photosensitive drum can be done effectively.

The image forming apparatus according to the invention is still further characterized in that the photosensitive member includes a photosensitive drum with a diameter of 30 mm or less for use in a small-size image forming unit.

Since the cleaning and discharging can be effected merely by attaching a conductive polyethylene terephalate to the tip end of a cleaning blade, the apparatus can be made compact in size and hence applicable advantageously to a small-size unit using a photosensitive drum with a diameter of 30 mm or less.

The image forming apparatus according to the invention is also characterized in that the cleaning blade and the conductive polyethylene terephalate cooperate to form a cleaning device and the waste toner accumulated in the cleaning device is collected by a rotatable paddle.

The provision of the rotatable paddle (i.e., transport paddle) adjacent to the cleaning device which is located above the photosensitive drum and constructed to include a cleaning blade and a conductive polyethylene terephalate permits efficient collection of residual waste toner into a toner collection box.

Furthermore, the image forming apparatus according to the invention is characterized in that the photosensitive member comprises an organic photo conductor which is negatively charged for image formation, the conductive polyethylene terephalate being operable to erase residual positive charge remaining on the surface of such organic photo conductor by negatively charging the toner accumulated on the surface thereof after the transferring step.

It is significant to note that there is an increasing demand for an organic photo conductor (OPC) for application to an image forming apparatus for its advantages in terms of cost, safety and wavelength selectivity and, therefore, most of today's new products of image forming apparatus employ OPC. Injection of negative charge to the residual toner by way of the conductive polyethylene terephalate can erase easily the residual positive charge on the OPC surface.

Still furthermore, the image forming apparatus according to the invention is characterized in that erasing the positive charge on the surface of the organic photo conductor assists in improving the build-up time in charging the organic photo conductor in the subsequent cycle of image forming operation.

According to the image forming apparatus of the invention wherein the positive residual charge on the surface of the organic photo conductor can be erased by injecting negative charge to the residual toner, the time of build-up in negatively charging in the next charging step can be shortened.

DESCRIPTION OF THE PREFERRED EMBODIMENTS

Figure 1:
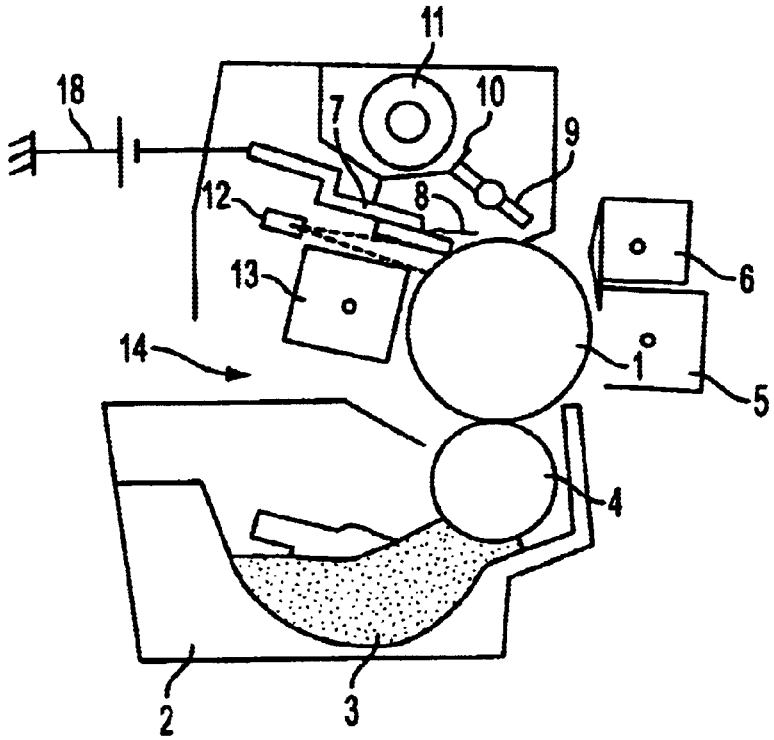
FIG. 1 is a schematic view showing, in section, the structure of an image forming apparatus constructed according to the present invention.

With reference to the accompanying drawings, embodiments of a discharging and charging mechanism in an image forming apparatus according to the present invention will be described in detail in the following. FIG. 1 is a schematic view showing, in section, the structure of the image forming apparatus of the present invention. This image forming apparatus is comprised of a photosensitive drum 1, a developing apparatus 2 including a developing roller 4 for holding and feeding magnetic toner 3 (referred to merely as "toner" hereinafter) for visualizing a latent image carried on the photosensitive drum 1, a transfer device 5 for transferring visualized image on the photosensitive drum 1 to an image-transferred medium such as a sheet of image recording paper (not shown), a separator 6 for separating or peeling off from the surface of the photosensitive drum 1 a paper sheet having an image transferred thereto, a cleaning blade 7 having a conductive polyethylene terephalate 8 for cleaning residual toner 3 remaining on the surface of the photosensitive drum 1 after the transferring step, a transport paddle 9 for arranging uniformly the residual toner (not shown) removed by cleaning and present on the surface of the photosensitive drum 1 and raking such toner toward a polyethylene terephalate 10 located above the paddle 9, a spiral auger 11 for transporting the residual toner into a toner collecting box (not shown), an erase lamp 12 for erasing the residual charge remaining on the surface of the photosensitive drum surface, an electrostatic charging device or charger 13 for providing a potential to the surface of the photosensitive drum 1 to form a desired latent image thereon, and exposure means 14 for altering the surface potential on the photosensitive drum by exposure with laser beam thereby to form a desired latent image.

Image forming by the image forming apparatus constructed as shown in FIG. 1 is performed in the following manner. Firstly, the photosensitive drum 1 is charged on its surface by the charger 13 to a desired surface potential VO (e.g. −630 V). Then, latent image is formed on the photosensitive drum 1 by exposure by laser beam emitted from the exposure means 14. In this exposing step, the surface potential for the image forming portion on the photosensitive drum 1 is attenuated to a residual potential level Vr (e.g. −40 V). After the desired latent image has been formed, reversal development is performed by the developing apparatus 2 with a low-resistant toner 3 which is charged in the same polarity as the photosensitive drum surface (e.g. −460 V).

The toner 3 thus attached onto the surface of the photosensitive drum 1 in the developing step is transferred to the recording paper sheet with the positive polarity by the transfer device 5. The recording paper sheet having the image thus transferred thereto is separated by the separator 6 from the photosensitive drum 1 with the negative polarity. The surface of the photosensitive drum 1 from which the recording paper sheet has been separated has the positive charge applied thereto during the transferring step and waste toner (not shown) remains adhering to the drum surface after the transfer. Such waste toner remaining attached to surface of the photosensitive drum 1 after the transfer undergoes cleaning by the cleaning blade 7 and is accumulated gradually at edge portions of the photosensitive drum 1. The accumulated toner is distributed uniformly by the transport paddle 9 and brought into uniform contact with the conductive polyethylene terephalate 8 for superimposed bias application in negative polarity.

The waste toner in contact with the conductive polyethylene terephalate 8 undergoes charge injection by way of the conductive polyethylene terephalate 8 thereby to be negatively charged, so that the toner in contact with the photosensitive drum 1 efficiently removes the positive charge present on the surface of the photosensitive drum 1. When the residual toner (not shown) exceeds a predetermined amount, it is picked upwardly by the transport paddle 9 and collected into the collection box (not shown) by the spiral auger 11. Then, the residual charge existing on the photosensitive drum surface is diselectrified by the erase lamp 12. The above steps are repeated for each image forming operation.

Figure 2:
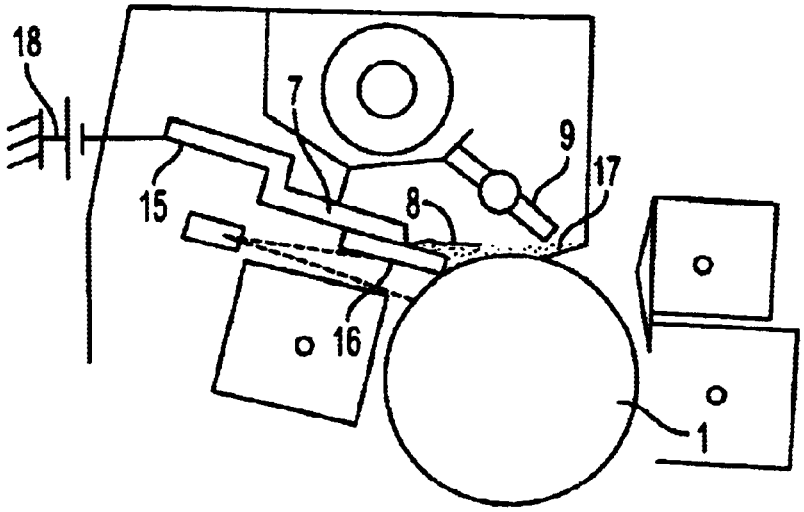
FIG. 2 is a view showing a cleaning blade 7 and a conductive polyethylene terephalate 8 provided in the image forming apparatus of FIG. 1.

FIG. 2 is a view showing more in detail the cleaning blade 7 and the conductive polyethylene terephalate 8 in the image forming apparatus of FIG. 1. The blade 7 is comprised of a metal plate 15 and an elastic rubber member 16 so arranged that the latter adhered to the former is brought into contact with the photosensitive drum 1. The conductive polyethylene terephalate 8 receives a bias voltage from the metal plate 15 to charge the waste magnetic toner 17 by charge injection. For this purpose, the metal plate 15 is applied with a voltage of a negative potential by a bias voltage source 18.

The conductive polyethylene terephalate 8 is disposed adjacent to the tip end edge of the cleaning blade 7, extending beyond the blade tip end edge by about 0.5 mm so that no pressure is exerted by the polyethylene terephalate 8 to the residual toner (not shown) subject to cleaning. As a matter of course, the conductive polyethylene terephalate 8 may be so shaped that its end is bent along the edge of the cleaning blade 7. Provision of the conductive polyethylene terephalate 8 adjacent to the surface of the photosensitive drum 1 according to the present invention makes it possible to perform the desired discharging even when there exists substantially no waste toner. Furthermore, in an image forming apparatus of the invention, as far as a photosensitive drum uses low-resistant toner such as magnetic toner, discharging and charging of a positive charge on the surface of any photosensitive drum can be accomplished.

As shown in FIG. 2, the elastic non-conductive cleaning blade 7, to which the conductive polyethylene terephalate 8 is fixed, and the transport paddle 9 are disposed above the photosensitive drum 1 and the waste toner 17 subject to cleaning is gradually accumulated as residual toner adjacent to the cleaning blade 7 with an increase in the number of prints. As such residual toner is accumulated to a certain extent, part of the toner is uniformly distributed on the surface of the photosensitive drum 1 by the transport paddle 9. On the other hand, since the conductive polyethylene terephalate 8 is biased to a negative potential by the bias voltage source 18, the accumulated residual toner in contact with the conductive polyethylene terephalate 8 on the photosensitive drum 1 is charged to a negative potential by charge injection. Thus, the positive residual charge remaining on the photosensitive drum 1 after the transferring step can be erased by way of the accumulated residual toner. Because the photosensitive drum 1 is then applied with a negative potential by the accumulated residual toner, this will assist in negatively charging the photosensitive drum 1 in the next drum charging step, so that charging build-up can be expedited.

Figure 3:
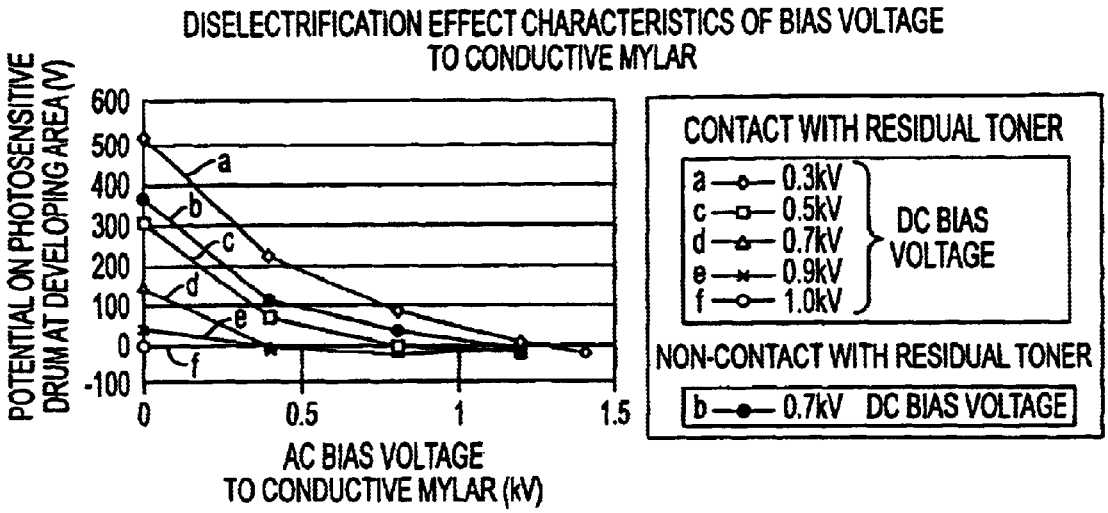
FIG. 3 is a characteristic graph showing the diselectrification effect of positive charge on the photosensitive drum when the conductive polyethylene terephalate is used in the image forming apparatus of the invention.

FIG. 3 is a characteristic graph showing the effect of diselectrification of positive charge on the photosensitive drum 1 when the conductive polyethylene terephalate 8 is used in the image forming apparatus of the invention. The characteristics curves of the graph were obtained under the measurement conditions in which various DC bias voltages were applied so as to diselectrify the positive charge on the photosensitive drum in two different cases, i.e. when the conductive polyethylene terephalate was in contact with the accumulated residual toner as the magnetic toner and when the polyethylene terephalate was free from such contact. That is, DC bias voltage to be superimposed on AC bias voltage for application to the conductive polyethylene terephalate was changed to various values as the measuring parameter. It is noted that the measuring test Was conducted only with the erase lamp in energized state.

In the graph of FIG. 3, the abscissa represents AC bias voltage (ACVp-p [kV]) for application to the conductive polyethylene terephalate, while the ordinate depicts potential (V) on the photosensitive drum at the developing area. Regarding the parameters of the graph, (a) represents application of DC bias voltage of −0.3 kV with the conductive polyethylene terephalate in contact with the waste toner, (c) application of DC bias voltage of −0.5 kV with the polyethylene terephalate in contact with the waste toner, (d) application of DC bias voltage of −0.7 kV with the polyethylene terephalate in contact with the waste toner, (e) application of DC bias voltage of −0.9 kV with the polyethylene terephalate in contact with the waste toner, and (a) application of DC bias voltage of −1.0 kV with the polyethylene terephalate in contact with the waste toner, respectively. The parameter (b) represents application of DC bias voltage of −0.7 kV with the polyethylene terephalate not in contact with the waste toner. In each characteristic curve of the graph, the surface potential of the photosensitive drum became 0 V, or completely discharged, when AC bias voltage to the conductive polyethylene terephalate on the abscissa of the graph is 1.2 kV or greater. As seen from the graph, complete discharging could be accomplished by application of AC bias voltage of 1.2 kV, irrespective of DC bias voltage for superimposition thereon, although preferably AC bias voltage of 1.2 kV or greater should be applied with application of superimposing DC −0.7 kV on the AC bias voltage.

Figure 4:
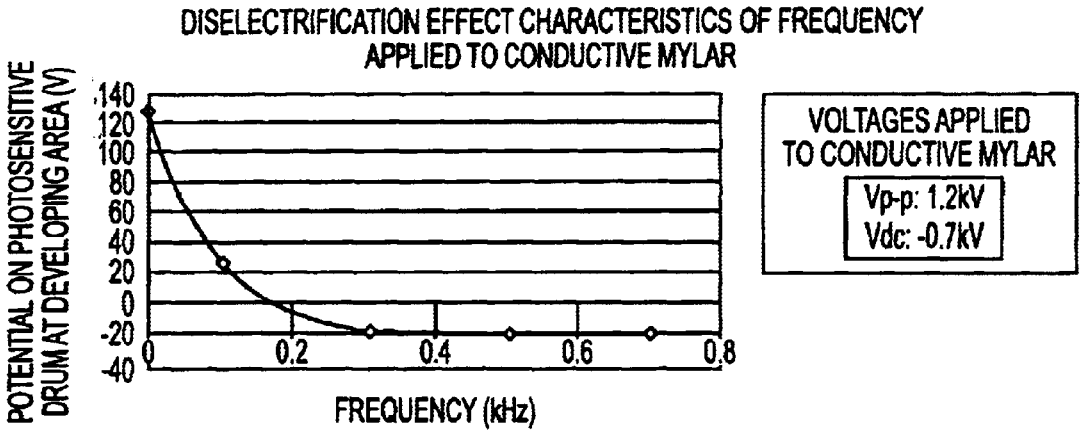
FIG. 4 is a characteristic graph showing the diselectrification effect, which varies depending on the frequency of AC bias voltage applied to the conductive polyethylene terephalate.

FIG. 4 is a characteristic graph showing the discharging effect, which varies depending on the frequency of AC bias voltage applied to the conductive polyethylene terephalate. The measurement was made under the conditions in which a voltage formed by superimposing DC voltage of −0.7 kV on AC voltage of 1.2 kV was applied to the conductive polyethylene terephalate while changing the frequency of the AC bias voltage. The abscissa of the graph represents the frequency (kHz) of the AC bias voltage and the ordinate depicts the surface potential (V) of the photosensitive drum at the developing area, respectively. As seen from the graph, the photosensitive drum surface potential became zero by charge injection to the waste toner through application of a voltage formed by imposing DC voltage of −0.7 kV or grater on AC voltage of 1.2 kV or greater to the conductive polyethylene terephalate at an AC bias voltage frequency of 300 Hz or greater. In other words, highly efficient diselectrification could be achieved under the above conditions.

Figure 5:
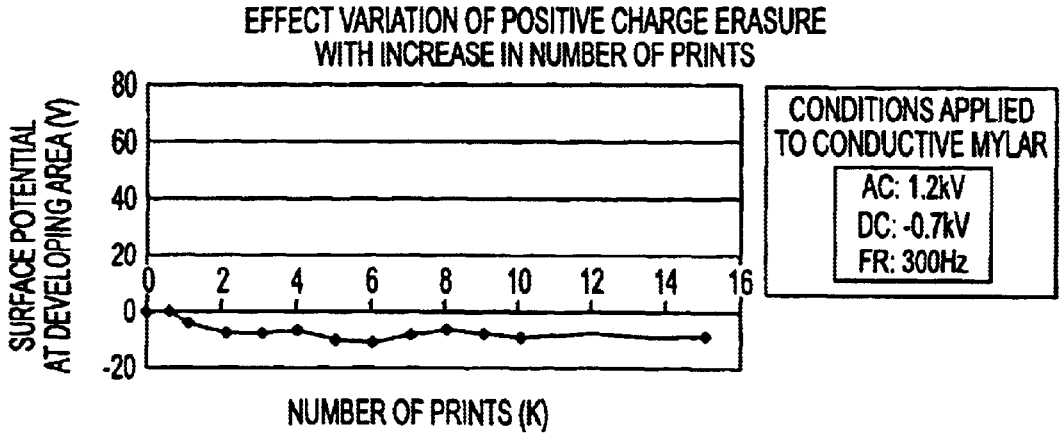
FIG. 5 is a characteristic graph showing the effect of diselectrification of positive charge, which varies with an increase in number of prints.

FIG. 5 is a characteristic graph showing the effect of diselectrification of positive charge which varies with an increasing number of prints. The abscissa of the graph depicts an increasing number of prints in the increment of 1,000 prints and the ordinate the surface potential of the photosensitive drum at the developing area, respectively. The measurements were made under the conditions in which a voltage formed by superimposing DC voltage of −0.7 kV on AC voltage of 1.2 kV was applied to the conductive polyethylene terephalate with the AC bias voltage frequency set at 300 Hz. Additionally, this short-running test was conducted under ambient temperature of 10° C. and relative humidity of 20%, using a drum, which had already exceeded its ordinary standard life.

As is apparent form the graph of FIG. 5 for the short-running test under AC voltage of 1.2 kV, DC voltage of −0.7 kV and frequency of 300 Hz, the surface potential of the photosensitive drum at the developing area remained around 0 V in printing up to 15,000 sheets of paper. This means that optimum discharging effect can be achieved by applying to the conductive polyethylene terephalate a voltage formed by superimposing DC voltage of −0.7 kV on AC voltage of 1.2 kV with the AC bias voltage frequency set at 300 Hz.

Figures 6, 7:
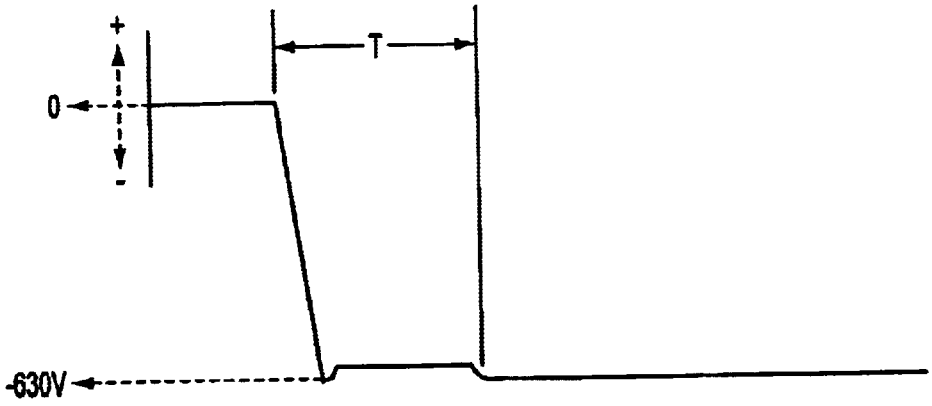
FIG. 6 is a waveform showing a build-up profile of the surface potential of the photosensitive drum.
FIG. 7 is a table comparing the build-up time of potential of the photosensitive drum between conventional apparatus and the apparatus of present invention.

The following will deal with the charge build-up characteristic of the photosensitive drum of the image forming apparatus of the present invention. FIG. 6 is a waveform showing a build-up characteristic of the surface potential of the photosensitive drum. In the waveform of FIG. 6, the elapse of time is represented by the abscissa and the magnitude of the surface potential of the photosensitive drum by the ordinate, wherein the drum surface was charged from 0 V to −630 V. Time T in the diagram designates the build-up time of the surface potential by charging, which shows that the surface potential is unstable during this build-up time T.

FIG. 7 is a table comparing the build-up time of potential of the photosensitive drum between conventional apparatus and the apparatus constructed according to present invention. Testing for the comparison was conducted with a conventional apparatus which used a non-conductive cleaning blade with no voltage applied thereto and an apparatus of the present invention which used a non-conductive cleaning blade with a conductive polyethylene terephalate under a condition of application of a voltage formed by imposing DC voltage of −0.7 kV on AC voltage of 1.2 kV with the frequency of AC bias voltage set at 300 Hz. As shown in the table providing the testing results, the built-up time T achieved by the conventional apparatus was 1.6 seconds, while the apparatus of the invention could shorten the time to 0.4 seconds.

As is apparent from the above testing results, application of a voltage formed by imposing DC voltage of −0.7 kV on AC voltage of 1.2 kV to the conductive polyethylene terephalate with the frequency of AC bias voltage set at 300 Hz makes possible stabilizing the surface potential of the photosensitive drum more rapidly than heretofore. It is noted that the present invention is applicable to all kinds of low-resistant toners such as magnetic toner. Raid stabilization of the photosensitive drum can be realized merely by means of the conductive polyethylene terephalate without using an erase lamp even if the conductive polyethylene terephalate is shaped so as to suit various specific process arrangements.

It is to be noted that the above-described embodiment has been provided only by way of example for the illustration of the present invention and, therefore, the invention is not limited to such embodiment, but various modifications may be made within the scope of the present invention. For example, although the above embodiment employs an organic photo conductor (OPC) charging negative potential to diselectrify positive charge generated during the transferring step, the present invention is not limited thereto, but applicable to such an application which employs a photo conductor charging positive potential to diselectrify negative charge generated during the transferring step.

As is apparent from the foregoing description, in a developing system using a magnetic toner of an image forming apparatus according to the present invention, waste toner removed by cleaning with a cleaning blade can accumulated uniformly on the surface of the photosensitive drum, and a voltage is applied to the accumulated toner by a voltage-biased conductive polyethylene terephalate to perform charge injection. By so doing, the charged waste toner can diselectrify the positive charge on the photosensitive drum, and this will also assist in rapid charge build-up of the photosensitive drum in the next drum-charging step.

The use of the conductive polyethylene terephalate permits utilization of a conventional non-conductive cleaning blade made of elastic material such as rubber, thereby making it possible to maintain satisfactory cleaning capability. Furthermore, the conductive polyethylene terephalate is advantageous in terms of the ease of installation and the space factor. Additionally, the flexible polyethylene terephalate can be shaped easily by bending, so that it is usable in various forms. Thus, the conductive polyethylene terephalate is advantageously applicable as a discharging mechanism for erasing positive charge in a small-size process unit having a photosensitive drum with a diameter of about 30 mm. Still furthermore, according to the invention, the surface of the photosensitive drum can be discharged with high efficiency by making use of residual toner removed by cleaning with the cleaning blade in such a way that a voltage is applied to the conductive polyethylene terephalate and the accumulated residual toner in contact with the polyethylene terephalate is charged by charge injection. Such synergistic effects help to shorten the charge build-up time and, therefore, if such polyethylene terephalate is applied to an apparatus having a small-diameter photosensitive drum in which the time before the developing step after the charging step is short, discharging can be achieved still more effectively.

What is claimed is:

1. An image forming apparatus comprising:

a photosensitive member for forming thereon a latent image;

a developing apparatus for visualizing said latent image on said photosensitive member with a toner having an electrical resistance;

a transfer device for transferring said visualized latent image to an image recording medium;

a non-conductive cleaning blade for cleaning residual toner adhering to a surface of said photosensitive member after the transfer of said visualized latent image to said image recording medium by said transfer device; and a conductive film fixedly attached to a tip end of said non-conductive cleaning blade for applying a bias voltage of a predetermined magnitude to said residual toner, said conductive film being applied with said bias voltage to charge said residual toner remaining on said surface of said photosensitive member by charge injection from said bias voltage applied to said conductive film, whereby at least part of a surface potential of said photosensitive member is removed.

2. An image forming apparatus according to claim 1, wherein said conductive film comprises polyethylene terephalate.

3. An image forming apparatus according to claim 2, further comprising means for causing part of said residual toner to be accumulated uniformly on the surface of said photosensitive member.

4. An image forming apparatus according to claim 2, wherein said bias voltage applied to said conductive film comprises a superimposed voltage obtained by imposing a DC voltage of at least −0.7 kV on an AC voltage of at least 1.2 kV with a frequency of at least 300 Hz.

5. An image forming apparatus according to claim 2, wherein said cleaning blade is made of an elastic material.

6. An image forming apparatus according to claim 2, wherein said photosensitive member comprises a photosensitive drum with a diameter of not greater than 30 mm for use in a small-size image forming unit.

7. An image forming apparatus according to claim 2, further comprising a rotatable paddle, wherein said cleaning blade and said conductive film cooperate to form a cleaning device and said paddle is operable to collect waste toner accumulated to said cleaning device.

8. An image forming apparatus according to claim 2, wherein said photosensitive member comprises an organic photoreceptor drum which is negatively charged for image formation, said conductive film being operable to diselectrify a residual positive charge remaining on said surface of said photosensitive member by negatively charging said residual toner adhering to said surface of said photosensitive member after the transfer to said image recording medium.

9. An image forming apparatus according to claim 8, wherein a subsequent charging build-up speed of said organic photoreceptor drum is increased by diselectrification of the positive charge on the surface of said organic photoreceptor drum.

10. An image forming apparatus according to claim 1, wherein said conductive film has an end bent along an edge of said non-conductive cleaning blade.

11. An image forming apparatus according to claim 1, wherein said conductive film extends beyond said tip end of said non-conductive cleaning blade such that substantially no pressure is exerted by said conductive film on said residual toner.

12. An image forming apparatus according to claim 1, wherein said toner comprises a low resistance toner.

13. An image forming apparatus according to claim 1, wherein said conductive film performs raid stabilization on said photosensitive member without an erase lamp.

14. An image forming apparatus, comprising:

means for forming a latent image on a photosensitive member;

means for visualizing said latent image with a toner having an electrical resistance on said means for forming;

means for transferring said visualized image to an image recording medium;

means for cleaning a residual toner remaining on a surface of said means for forming after the transfer to said image recording medium; and means for charge injecting a bias voltage of a predetermined magnitude to said residual toner, whereby at least part of a surface potential of said means for forming is removed, wherein said means for applying a bias voltage includes a conductive film fixedly attached to a tip end of said means for cleaning.

15. An image forming apparatus according to claim 14, wherein said conductive film comprises polyethylene terephalate.

16. An image forming apparatus according to claim 15, further comprising:

means for causing part of said residual toner to be accumulated uniformly on surface of said means for forming.

17. An image forming apparatus according to claim 15, wherein said bias voltage comprises a superimposed voltage obtained by imposing a DC voltage of at least −0.7 kV on an AC voltage of at least 1.2 kV with a frequency of at least 300 Hz.

18. A method of forming an image, comprising:

visualizing a latent image on a photosensitive member with a toner having an electrical resistance;

transferring said visualized image to an image recording medium;

cleaning with a cleaning blade a residual toner adhering to a surface of said photosensitive member after the transfer of said latent image to said image recording medium; and charge injecting a biasing voltage of a predetermined magnitude to said residual toner with a conductive film, whereby at least part of a surface potential of said photosensitive member is removed, wherein said conductive film is fixedly attached to a tip end of said cleaning blade.

19. A method according to claim 18, wherein said conductive film comprises polyethylene terephalate.

20. A method according to claim 19, wherein said bias voltage comprises a superimposed voltage obtained by imposing a DC voltage of at least −0.7 kV on an AC voltage of at least 1.2 kV with a frequency of at least 300 Hz.

* * * * *